US006986282B2

(12) United States Patent
Ciglenec et al.

(10) Patent No.: US 6,986,282 B2
(45) Date of Patent: Jan. 17, 2006

(54) METHOD AND APPARATUS FOR DETERMINING DOWNHOLE PRESSURES DURING A DRILLING OPERATION

(75) Inventors: Reinhart Ciglenec, Katy, TX (US); Albert Hoefel, Sugar Land, TX (US)

(73) Assignee: Schlumberger Technology Corporation

( * ) Notice: Subject to any disclaimer, the term of this patent is extended or adjusted under 35 U.S.C. 154(b) by 307 days.

(21) Appl. No.: 10/248,782

(22) Filed: Feb. 18, 2003

(65) Prior Publication Data

US 2004/0160858 A1 Aug. 19, 2004

(51) Int. Cl.
*E21B 47/06* (2006.01)

(52) U.S. Cl. ..... 73/152.51; 73/152.43
(58) Field of Classification Search ..... 73/152.51, 73/152.48, 152.43
See application file for complete search history.

(56) References Cited

U.S. PATENT DOCUMENTS

| | | | | |
|---|---|---|---|---|
| 2,915,123 | A | * 12/1959 | Lebourg | 166/63 |
| 3,355,939 | A | * 12/1967 | Gils | 73/152.51 |
| 3,459,264 | A | * 8/1969 | Blevins et al. | 166/250.17 |
| 3,627,065 | A | * 12/1971 | Murphy | 175/48 |
| 3,782,191 | A | 1/1974 | Whitten | |
| 3,934,468 | A | 1/1976 | Brieger | |
| 3,968,844 | A | * 7/1976 | Walther et al. | 175/48 |
| 4,614,148 | A | * 9/1986 | Bates | 91/420 |
| 4,676,096 | A | 6/1987 | Bardsley et al. | |
| 4,805,449 | A | * 2/1989 | Das | 73/152.48 |
| 4,860,581 | A | 8/1989 | Zimmerman et al. | |
| 4,893,505 | A | 1/1990 | Mueller | |
| 4,936,139 | A | 6/1990 | Zimmerman et al. | |
| 5,095,745 | A | 3/1992 | Desbrandes | |
| 5,233,866 | A | 8/1993 | Desbrandes | |
| 5,303,582 | A | 4/1994 | Miska | |
| 5,555,945 | A | 9/1996 | Schultz et al. | |
| 5,622,223 | A | 4/1997 | Vasquez | |
| 5,703,286 | A | 12/1997 | Proett et al. | |
| 5,770,798 | A | 6/1998 | Georgi et al. | |
| 5,789,669 | A | 8/1998 | Flaum | |
| 5,799,733 | A | 9/1998 | Ringgenberg et al. | |
| 5,803,186 | A | 9/1998 | Berger et al. | |
| 5,969,241 | A | 10/1999 | Auzerais | |
| 6,006,834 | A | 12/1999 | Skinner | |
| 6,026,915 | A | 2/2000 | Smith et al. | |
| 6,047,239 | A | 4/2000 | Berger et al. | |
| 6,157,893 | A | 12/2000 | Berger et al. | |
| 6,164,126 | A | 12/2000 | Ciglenec et al. | |

(Continued)

FOREIGN PATENT DOCUMENTS

| | | | |
|---|---|---|---|
| GB | 2 333 308 | | 7/1999 |
| GB | 2333308 A | * | 7/1999 |
| WO | WO 01/33044 | | 5/2001 |
| WO | WO 02/08570 | | 1/2002 |

*Primary Examiner*—Hezron Williams
*Assistant Examiner*—John Fitzgerald
(74) *Attorney, Agent, or Firm*—J. L. Jennie Salazar; Brigitte L. Echols; Victor H. Segura

(57) ABSTRACT

A method and apparatus is provided to collect downhole data during a drilling operation via a downhole tool. A differential pressure is created by the difference between internal pressure of fluid passing through the downhole tool and the annular pressure in the wellbore. The apparatus includes a drill collar connectable to the downhole drilling, and has an opening extending into a chamber therein. A piston is positioned in the chamber and has a rod extending into the opening. The piston is movable between a closed position with the rod filling the opening, and an open position with the rod retracted into the chamber to form a cavity for receiving downhole fluid. A sensor is positioned in the rod for collecting data from fluid in the cavity. The apparatus may also be provided with a probe and/or hydraulic circuitry to facilitate the collection of data.

58 Claims, 7 Drawing Sheets

U.S. PATENT DOCUMENTS

| | | | | |
|---|---|---|---|---|
| 6,230,557 | B1 | | 5/2001 | Ciglenec et al. |
| 6,236,620 | B1 | | 5/2001 | Schultz et al. |
| 6,325,146 | B1 | | 12/2001 | Ringgenberg et al. |
| 6,340,062 | B1 | | 1/2002 | Skinner |
| 6,343,650 | B1 | | 2/2002 | Ringgenberg |
| 6,427,530 | B1 | | 8/2002 | Krueger et al. |
| 6,568,487 | B2 | | 5/2003 | Meister et al. |
| 2002/0060094 | A1 | * | 5/2002 | Meister et al. ..... 175/50 |
| 2002/0185313 | A1 | | 12/2002 | Jones et al. |
| 2003/0094040 | A1 | * | 5/2003 | Proett et al. ..... 73/152.05 |
| 2004/0020649 | A1 | | 2/2004 | Fields |
| 2004/0025583 | A1 | * | 2/2004 | Kurkjian et al. ..... 73/152.51 |
| 2004/0083805 | A1 | | 5/2004 | Ramakrishnan et al. |
| 2004/0237640 | A1 | * | 12/2004 | Meister et al. ..... 73/152.48 |

* cited by examiner

METHOD AND APPARATUS FOR DETERMINING DOWNHOLE PRESSURES DURING A DRILLING OPERATION

BACKGROUND OF INVENTION

1. Field of the Invention

This invention relates generally to the determination of various downhole parameters in a subsurface formation penetrated by a wellbore. More particularly, this invention relates to the determination downhole parameters, such as annular, formation and/or pore pressure, during a drilling operation.

2. Description of the Related Art

Present day oil well operation and production involves continuous monitoring of various subsurface formation parameters. One aspect of standard formation evaluation is concerned with the parameters of reservoir pressure and the permeability of the reservoir rock formation. Continuous monitoring of parameters such as reservoir pressure and permeability indicate the formation pressure change over a period of time, and is essential to predict the production capacity and lifetime of a subsurface formation.

Present day operations typically obtain these parameters through wireline logging via a "formation tester" tool. This type of measurement requires a supplemental "trip" downhole. In other words, the drill string must be removed from the wellbore so that a formation tester may be run into the wellbore to acquire the formation data and, after retrieving the formation tester, running the drill string back into the wellbore for further drilling. Thus, it is typical for formation parameters, including pressure, to be monitored with wireline formation testing tools, such as those tools described in U.S. Pat. Nos.: 3,934,468; 4,860,581; 4,893,505; 4,936,139; and 5,622,223. Each of these patents is limited in that the formation testing tools described therein are only capable of acquiring formation data as long as the wireline tools are disposed in the wellbore and in physical contact with the formation zone of interest. Since "tripping the well" to use such formation testers consumes significant amounts of expensive rig time, it is typically done under circumstances where the formation data is absolutely needed, when tripping of the drill string is done for a drill bit change or for other reasons.

The availability of reservoir formation data on a "real time" basis during well drilling activities is a valuable asset. Real time formation pressure obtained while drilling will allow a drilling engineer or driller to make decisions concerning changes in drilling mud weight and composition, as well as penetration parameters, at a much earlier time to thus promote the safety aspects of drilling. The availability of real time reservoir formation data is also desirable to enable precision control of drill bit weight in relation to formation pressure changes and changes in permeability so that the drilling operation can be carried out at its maximum efficiency.

Techniques have been developed to acquire formation data from a subsurface zone of interest while the downhole drilling tool is present within the wellbore, and without having to trip the well to run formation testers downhole to identify these parameters. Examples of techniques involving measurement of various downhole parameters during drilling are set forth in U.K. Patent Application GB 2,333,308 assigned to Baker Hughes Incorporated, U.S. Pat. No. 6,026,915 assigned to Halliburton Energy Services, Inc. and U.S. Pat. Nos. 6,230,557 and 6,164,126 assigned to the assignee of the present invention.

Despite the advances in obtaining downhole formation parameters, there remains a need to further develop reliable techniques which permit data collection during the drilling process. Benefits may also be achieved by utilizing the wellbore environment and the existing operation of the drilling tool to facilitate measurements. It is desirable that such techniques be provided that are automatic and/or without the need of signals from the surface to activate operation. It is further desirable that such techniques provide one or more of the following, among others, simplified operation, minimal impact on the drilling operation, fast operation, minimal test volume, external testing of a variety of downhole parameters, elimination of test flow line, multiple test devices about the tool for multiple opportunities for test results, reduction or elimination the use of motors, pumps and/or valves, low power consumption, reduction in moving parts, compact design, durability for even high impact operations, rapid response. Added benefit would be achieved where such a device could be used in combination with a pre-test piston to provide pressure readings, pretest functions as well as other downhole data.

SUMMARY OF INVENTION

The invention relates generally to an apparatus for collecting downhole data during a drilling operation via a downhole drilling tool positioned in a wellbore. The wellbore has an annular pressure therein. The wellbore penetrates a subterranean formation having a pore pressure therein. The downhole tool is adapted to pass a drilling mud flowing therethrough such that an internal pressure is created therein. The internal pressure and annular pressure generate a differential pressure therebetween.

In at least one aspect, the apparatus includes a drill collar, a piston and a sensor. The drill collar is operatively connectable to a drill string of the drilling tool, and has a passage therein for passing the drilling mud therethrough. The drill collar has an opening therein extending into a pressure chamber. The pressure chamber is in fluid communication with the passage and/or the wellbore. The piston is slidably positioned in the pressure chamber and has a rod extending therefrom into the opening. The piston is movable to a closed position in response to an increase in differential pressure and to an open position in response to a decrease in differential pressure such that in the closed position the rod fills the opening and in the open position at least a portion of the rod is drawn into the chamber such that a cavity is formed in the opening for receiving downhole fluid. The sensor is positioned in the rod for collecting data from the downhole fluid in the cavity.

In another aspect, the apparatus includes a drill collar, a probe, a piston and a sensor. The drill collar is operatively connectable to a drill string of the drilling tool. The drill collar has a passage therein for passing the drilling mud therethrough. The drill collar has a collar opening therein extending into a pressure chamber. The pressure chamber is in fluid communication with the passage and/or the wellbore. The probe is slidably positioned in the pressure chamber. The probe movable between a retracted position in the pressure chamber and an extended position extending from the drill collar into the collar opening. The probe is positionable adjacent the sidewall of the wellbore for sealing engagement therewith. The probe has a probe opening therethrough extending into a probe chamber therein. The piston is slidably positioned in a probe chamber in the probe and has a rod extending therefrom into the probe opening. The piston is movable to a closed position in response to an increase in differential pressure and to an open position in response to a decrease in differential pressure such that in the closed position the rod fills the opening and in the open position at least a portion of the rod is drawn into the chamber such that a cavity is formed in the probe opening for receiving downhole fluid. The sensor is positioned in the rod for collecting data from the downhole fluid in the cavity.

The apparatus may be provided with a hydraulic control circuit to manipulate the internal and/or annular pressure for activation of the piston and/or probe. The hydraulics may also be used to affect the timing of tests performed by the piston and/or probe.

The sensor may be provided with circuitry arranged to facilitate collection and/or communication of data. The circuitry may be of an overlapping communication coil, back-to-back-coil and/or other arrangements.

Finally, in another aspect, the invention relates to a method of collecting downhole data during a drilling operation via a downhole drilling tool positioned in a wellbore. The wellbore has an annular pressure therein. The wellbore penetrating a subterranean formation having a pore pressure therein. A differential pressure being generated between the internal pressure and the annular pressure. The method comprises providing a downhole drilling tool with a drill collar having a passage therethrough, positioning the downhole drilling tool into a wellbore, selectively changing the differential pressure such that the piston is moved between the open and closed position, and sensing data from the downhole fluid in the cavity. The drill collar having an opening therein extending into a chamber and a piston slidably positioned in the chamber and having a rod extending therefrom into the opening. The piston is movable between a closed and an open position. Measurements may be taken continuously or at desired intervals.

Other aspects of the invention will be clear from the description provided herein.

DETAILED DESCRIPTION

Figure 1:
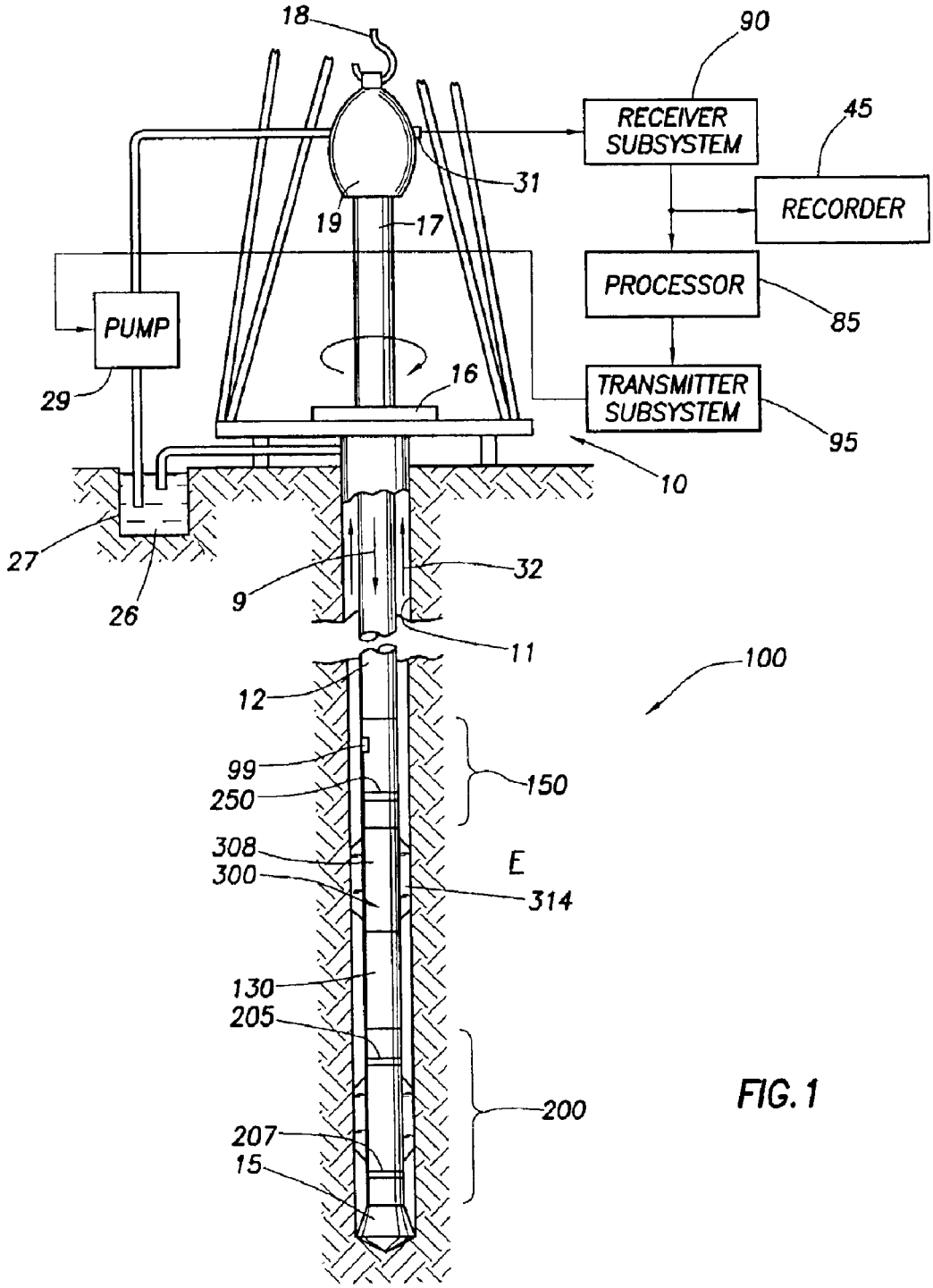
FIG. 1 is an elevational view, partially in section and partially in block diagram, of a conventional drilling rig and drill string employing the present invention.

FIG. 1 shows a typical drilling system and related environment. Land-based platform and derrick assembly 10 are positioned over wellbore 11 penetrating subsurface formation F. Wellbore 11 is formed by rotary drilling in a manner that is well known. Those of ordinary skill in the art given the benefit of this disclosure will appreciate, however, that the present invention also finds application in directional drilling applications as well as rotary drilling, and is not limited to land-based rigs.

Drill string 12 is suspended within wellbore 11 and includes drill bit 15 at its lower end. Drill string 12 is rotated by rotary table 16, energized by means not shown, which engages kelly 17 at the upper end of the drill string. Drill string 12 is suspended from hook 18, attached to a traveling block (also not shown), through kelly 17 and rotary swivel 19 which permits rotation of the drill string relative to the hook.

Drilling fluid or mud 26 is stored in pit 27 formed at the well site. Pump 29 delivers drilling fluid 26 to the interior of drill string 12 via a port in swivel 19, inducing the drilling fluid to flow downwardly through drill string 12 as indicated by directional arrow 9. The drilling fluid exits drill string 12 via, ports in drill bit 15, and then circulates upwardly through the region between the outside of the drillstring and the wall of the wellbore, called the annulus, as indicated by direction arrows 32. In this manner, the drilling fluid lubricates drill bit 15 and carries formation cuttings up to the surface as it is returned to pit 27 for recirculation.

The drilling mud performs various functions to facilitate the drilling process, such as lubricating the drill bit 15 and transporting cuttings generated by the drill bit during drilling. The cuttings and/or other solids mix within the drilling fluid to create a "mudcake" 160 that also performs various functions, such as coating the borehole wall.

The dense drilling fluid 26 conveyed by a pump 29 is used to maintain the drilling mud in the wellbore at a pressure (annular pressure $P_A$) higher than the pressure of fluid in the surrounding formation F (pore pressure $P_P$) to prevent formation fluid from passing from surrounding formations into the borehole. In other words, the annular pressure ($P_A$) is maintained at a higher pressure than the pore pressure ($P_P$) so that the wellbore is "overbalanced"($P_A > P_P$) and does not cause a blowout. The annular pressure ($P_A$) usually is also maintained below a given level to prevent the formation surrounding the wellbore from cracking, and to prevent drilling fluid from entering the surrounding formation. Thus, downhole pressures are typically maintained within a given range.

Drillstring 12 further includes a bottom hole assembly, generally referred to as 100, near the drill bit 15 (in other words, within several drill collar lengths from the drill bit). The bottom hole assembly includes capabilities for measuring, processing, and storing information, as well as communicating with the surface. Bottom hole assembly 100 thus includes, among other things, measuring and local communications apparatus 200 for determining and communicating the resistivity of formation F surrounding wellbore 11. Communications apparatus 200, including transmitting antenna 205 and receiving antenna 207, is described in detail in U.S. Pat. No. 5,339,037, commonly assigned to the assignee of the present application, the entire contents of which are incorporated herein by reference.

Assembly 100 further includes drill collar 130 for performing various other measurement functions, and surface/local communications subassembly 150. Subassembly 150 includes antenna 250 used for local communication with apparatus 200, and a known type of acoustic communication system that communicates with a similar system (not shown) at the earth's surface via signals carried in the drilling fluid or mud. Thus, the surface communication system in subassembly 150 includes an acoustic transmitter which generates an acoustic signal in the drilling fluid that is representative of measured downhole parameters.

One suitable type of acoustic transmitter employs a device known as a "mud siren" which includes a slotted stator and a slotted rotor that rotates and repeatedly interrupts the flow of drilling fluid to establish a desired acoustical wave signal in the drilling fluid. The driving electronics in subassembly 150 may include a suitable modulator, such as a phase shift keying (PSK) modulator, which conventionally produces driving signals for application to the mud transmitter. These driving signals can be used to apply appropriate modulation to the mud siren.

The generated acoustical wave is received at the surface by transducers represented by reference numeral 31. The transducers, for example, piezoelectric transducers, convert the received acoustical signals to electronic signals. The output of transducers 31 is coupled to uphole receiving subsystem 90, which demodulates the transmitted signals. The output of receiving subsystem 90 is then couple to processor 85 and recorder 45.

Uphole transmitting system 95 is also provided, and is operative to control interruption of the operation of pump 29 in a manner that is detectable by transducers 99 in subassembly 150. In this manner, there is two-way communication between subassembly 150 and the uphole equipment as described in greater detail in U.S. Pat. No. 5,235,285.

Drill string 12 is further equipped in the embodiment of FIG. 1 with stabilizer collar 300. Such stabilizing collars are utilized to address the tendency of the drill string to "wobble" and become decentralized as it rotates within the wellbore, resulting in deviations in the direction of the wellbore from the intended path (for example, a straight vertical line). Such deviation can cause excessive lateral forces on the drill string sections as well as the drill bit, producing accelerated wear. This action can be overcome by providing a means for centralizing the drill bit and, to some extent, the drill string, within the wellbore, such as stabilizer blades 314.

Figure 2:
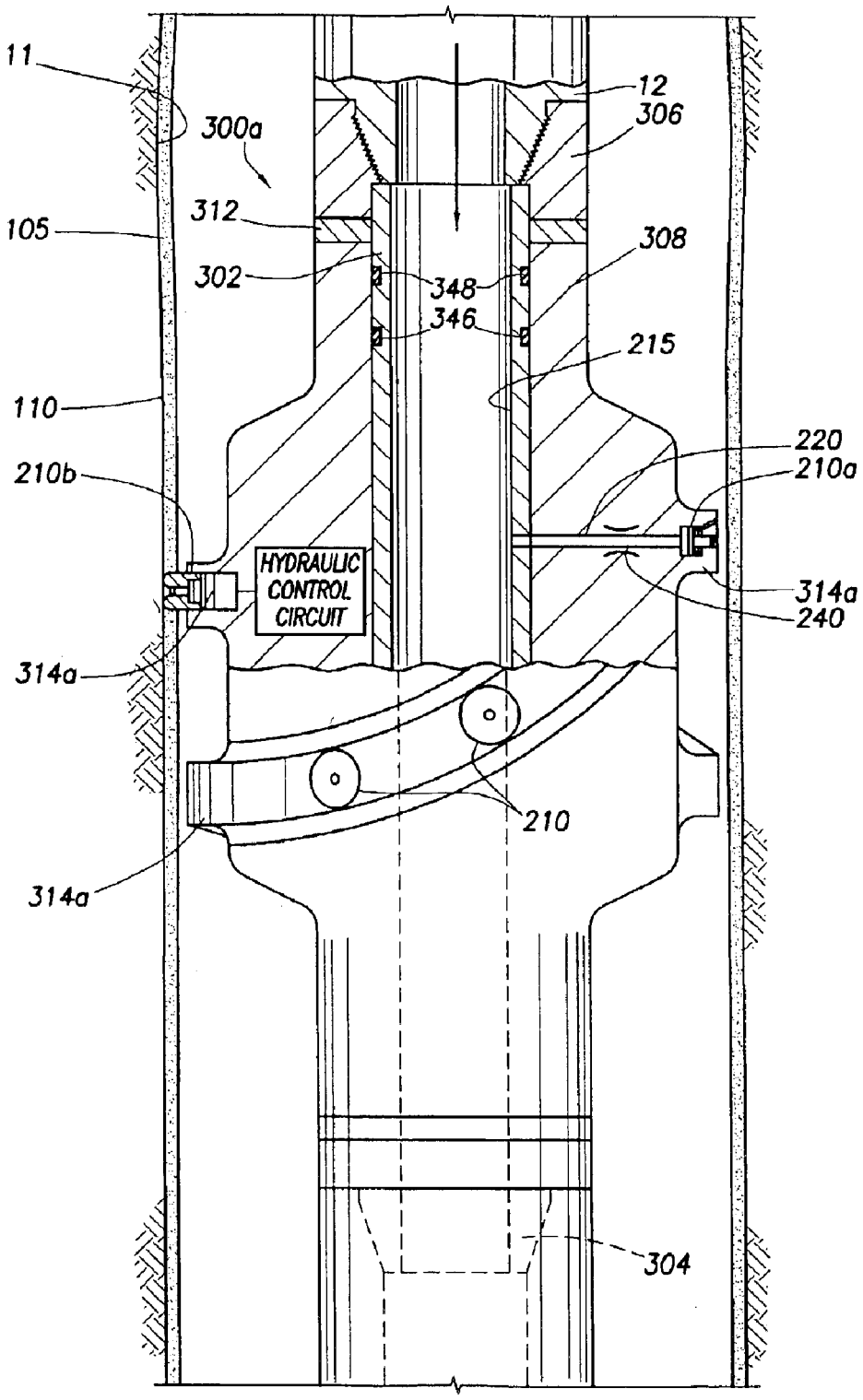
FIG. 2 is an elevational view, partially in section and partially in block diagram, of a stabilizer collar having pressure assemblies therein.

FIG. 2 illustrates a stabilizer collar 300*a*, partially in cross-section, usable in connection with a drilling tool, such as the drilling tool 100 of FIG. 1. The collar 300*a* is connected to a drill string 12 and positioned in a borehole 11 lined with mudcake 105. The stabilizer collar 300*a* includes a plurality of stabilizer blades 314*a* with pressure assemblies 210 therein. The collar 300*a* has a passage 215 extending therethrough for passage of drilling fluid through the downhole tool as indicated by the arrow. The flow of fluid through the tool creates an internal pressure $P_I$. The exterior of the drill collar is exposed to the annular pressure $P_A$ of the surrounding wellbore. The differential pressure $\delta P$ between the internal pressure $P_I$ and the annular pressure $P_A$ may be used to activate the pressure assemblies 210 as will be described further herein. If the desired differential pressure does not result from the bottom hole assembly arrangement, an additional choke (not shown) may be placed in the drill string to restrict flow and create back pressure.

The stabilizer collar 300*a* has a tubular mandrel 302 adapted for axial connection in a downhole tool, such as the drill string 12 of FIG. 1. Thus, mandrel 302 may be equipped with pin and box ends 304, 306 for conventional make-up within the drill string. As shown in FIG. 2, ends 304, 306 may be customized collars that are connected to the central elongated portion of mandrel 302 in a conventional manner, such as threaded engagement and/or welding.

Stabilizer collar 300 further includes stabilizer element or sleeve 308 positioned about tubular mandrel 302 between ends 304 and 306. Thrust bearings 312 are provided to reduce the frictional forces and bear the axial loads developed at the axial interface between sleeve 308 and mandrel ends 304, 306. Rotary seals 348 and radial bearings 346 are also provided at the radial interface between mandrel 302 and sleeve 308.

The stabilizer collar 300*a* of FIG. 2 has three spiral stabilizer blades 314*a* positioned about the circumference of the drill collar. The stabilizer blades 314*a* are connected, such as by welding or bolting, to the exterior surface of stabilizer sleeve 308. The blades are preferably spaced apart, and oriented in a spiral configuration, as indicated in FIG. 2, or axially (FIG. 1) along the stabilizer sleeve. It is presently preferred that the sleeve 308 include three such blades 314 distributed evenly about the circumference of the sleeve. However, the present invention is not limited to this three-blade embodiment, and may be utilized to advantage with other arrangements of the blades.

For illustration purposes a cross-sectional view of two embodiments of a pressure assembly 210*a* and 210*b* are depicted. Pressure assembly 210*a* is positioned within stabilizer blade 314*a* for performing various measurements. Pressure assembly 210*a* may be used to monitor annular pressure in the borehole and/or pressures of the surrounding formation when positioned in engagement with the wellbore wall. As shown in FIG. 2, pressure assembly 210*a* is in non-engagement with the borehole wall 110 and, therefore, may measure annular pressure, if desired. When moved into engagement with the borehole wall 110, the pressure assembly 210*a* may be used to measure pore pressure of the surrounding formation.

As best seen in FIG. 2, pressure assembly 210*b* is extendable from the stabilizer blade 314*a* for sealing engagement with the mudcake 105 and/or the wall 110 of the borehole 11 for taking measurements of the surrounding formation. The pressure assembly 210*b* may be activated, as described further herein, to extend from the stabilizer to reach the surrounding borehole to take the desired measurement. Optionally, the pressure assembly 210*b* may also be used to take annular pressures when in non-engagement with the borehole wall. One or more pressure assemblies of various configurations may be used in one or more stabilizer blades for performing the desired measurements.

Figure 3B:
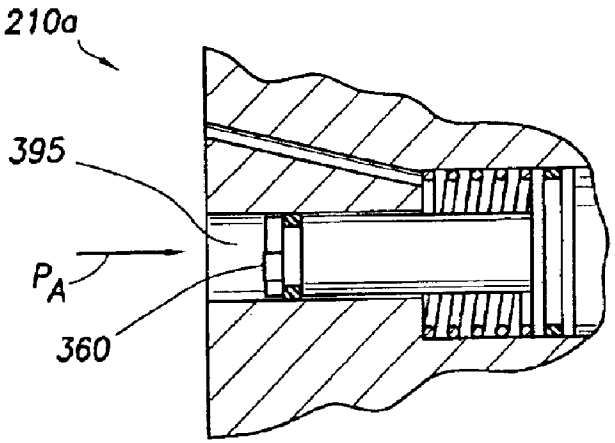
FIG. 3B is a cross-sectional view of another embodiment of a pressure assembly of FIG. 2 in the open position.
Figure 3A:
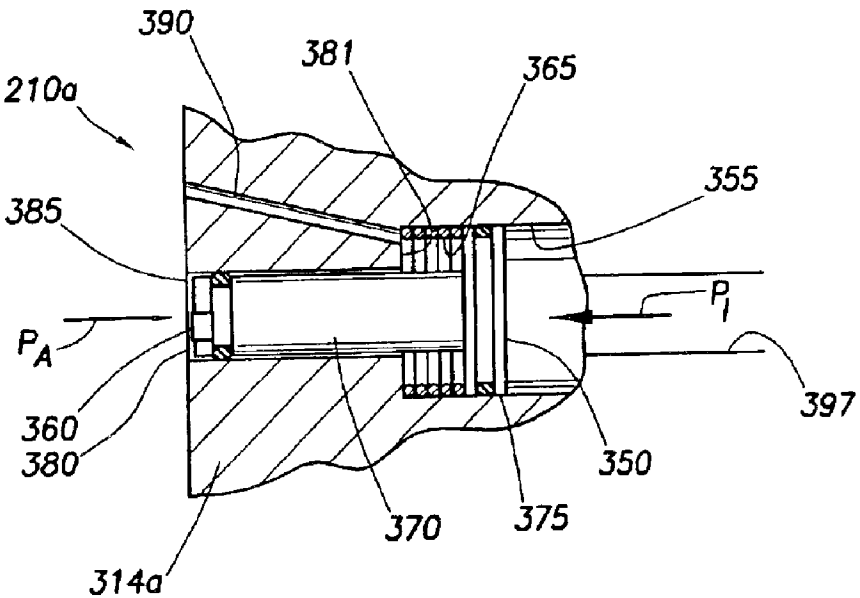
FIG. 3A is a cross-sectional view of a first embodiment of a pressure assembly of FIG. 2 in the closed position.

FIGS. 3A and 3B depict pressure assembly 210*a* in greater detail. FIG. 3A shows the pressure assembly 210*a* in a closed position. FIG. 3B shows the pressure assembly in a testing, or open, position. The pressure assembly 210*a* is positioned in a chamber 355 in the stabilizer blade 314*a*. The pressure assembly 210*a* includes a piston 350 and a spring 365. The piston has a first portion 375 slidably movable within a chamber 355 in the stabilizer blade 314*a*, and a second portion, or rod, 370 extending therefrom. The second portion 370 extends from the chamber 355 into a passage 380 and is slidably movable therein. The piston may be provided with seals to facilitate movement within the chamber and/or the passage. The passage 380 extends from an opening 385 in the drill collar, through the stabilizer blade 314*a* and into the chamber 355.

The piston is preferably provided with a sensor 360, such as a pressure gauge, capable of taking downhole measurements. The sensor is preferably exposed to fluids adjacent the first portion 370 of piston 350. The sensor may be enabled to monitor and/or selectively take readings, such as pressure measurements during the downhole operations.

Spring 365 is positioned about the first portion 370 in a pocket 381 formed in chamber 355 between the second portion 375 of the piston and the walls of the chamber. As shown in FIG. 3A, the spring is compressed in the pocket 381 between piston 350 and the chamber 355. Pocket 381 is in fluid communication with the wellbore via conduit 390. The chamber 355 is in fluid communication with the passage 215 (FIG. 2) of the downhole tool. Optionally, an oil filled piston may be provided in conduit 397 to isolate the drilling mud from the pressure assembly 210*a* while still allowing the pressure therein to apply.

During drilling operation, mud flowing through the downhole tool creates an internal pressure $P_I$ The internal pressure and borehole pressure $P_A$ create a differential pressure. When fluid is flowing in passage 215, the differential pressure increases and pressure is applied to the chamber 355. A choke 240 (FIG. 2) or similar device may be used to restrict or delay the passage of fluid through conduit 220 (FIG. 2) thereby delaying the movement of the piston. Once sufficient pressure is created in chamber 355, the internal pressure $P_I$ applies a force against piston 350 as shown by the arrow. This internal pressure is greater than the annual pressure $P_A$ and the force of spring 365 thereby causing the piston to move toward opening 385 in the stabilizer blade 314*a*.

Fluid in pocket 381 may freely pass between the borehole and the pocket via conduit 390. The first portion 375 of the piston compresses the spring 365. Second portion 370 moves towards opening 385 and fills the passage 380. Thus, while drilling fluid passes through the passage 215, internal pressure generated therefrom applies a force to the piston 350 and moves it to the closed position. When the pressure assembly is in non-engagement with the borehole wall and mudcake, the sensor may take downhole readings of the wellbore, such as the annular pressure $P_A$ of the wellbore.

As shown in FIG. 3B, when the tool comes to a rest and fluid stops flowing through the tool, the internal pressure drops and the pressure differential between the internal pressure and the borehole pressure in this case falls to about zero. The internal pressure is no longer available to apply force to piston 350 and compress spring 365, and the spring expands to its relaxed position. Expansion of the spring causes the piston to retract away from opening 385 and into the stabilizer blade. Fluid in cavity 355 may be expelled into passage 215 and/or borehole fluid may be drawn into chamber 381.

Retraction of the piston into the stabilizer blade creates a small cavity 395 (typically of about 1 cc to about 3 cc) extending from the opening 385 and into the passage 380. Pressure sensor 360 measures the pressure of the fluid in the cavity as the piston retracts into the tool. When in non-engagement with the wellbore wall, fluid from the borehole is permitted to fill the cavity 395. In this position, the sensor may take or continue to take borehole measurements. However, when the pressure assembly is in engagement with the borehole wall 110, retraction of the piston into the stabilizer blade will draw formation fluid into cavity 395 and provide formation data, such as pore or formation pressure. The flow of fluid into the cavity and the corresponding measurement may also be used to perform a pretest. Techniques for performing pretests are known by those of skill in the art and are described, for instance, in U.S. Pat. Nos. 4,860,581 and 4,936,139 issued to Zimmerman et al, both of which are assigned to the assignee of the present invention.

Once circulation of drilling fluid through the tool is re-initiated and sufficient differential pressure is present, the piston returns to the position of FIG. 3A. In this manner, the pressure assembly may be used to take multiple downhole measurements. When fluid is flowing through the downhole tool, the piston moves to the closed position of FIG. 3A in preparation for the next test. When fluid flow ceases, the piston is released to the open position of FIG. 3B and the draw-down cycle begins. The operation may be repeated as desired. Movement of the piston may be delayed by incorporating a choke into conduit 397 to restrict the flow out of chamber 355.

Figure 4A:
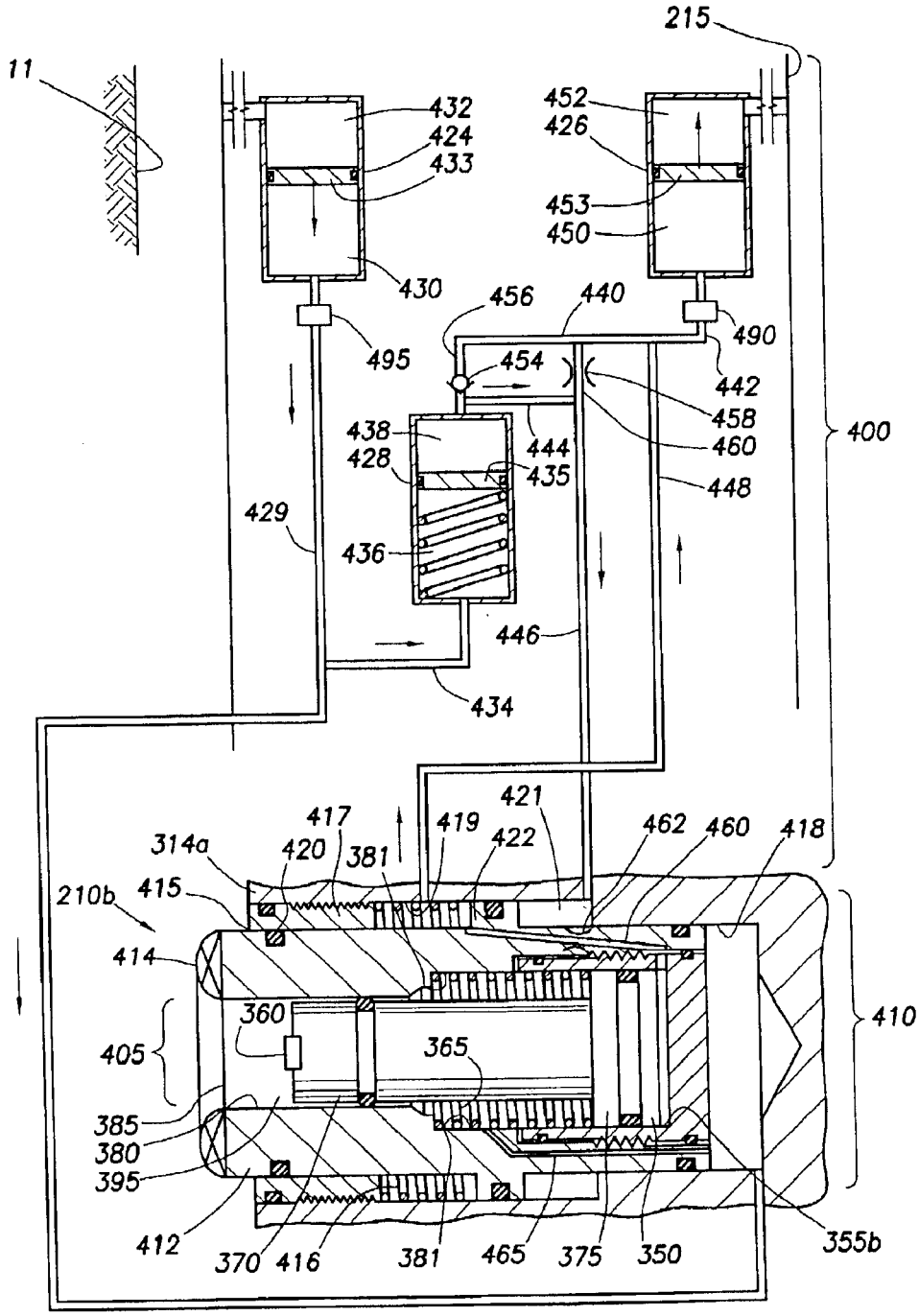
FIG. 4A is a cross-sectional view of a first embodiment of a pressure assembly of FIG. 3 in the extended position, and a corresponding hydraulic control diagram.
Figure 4B:
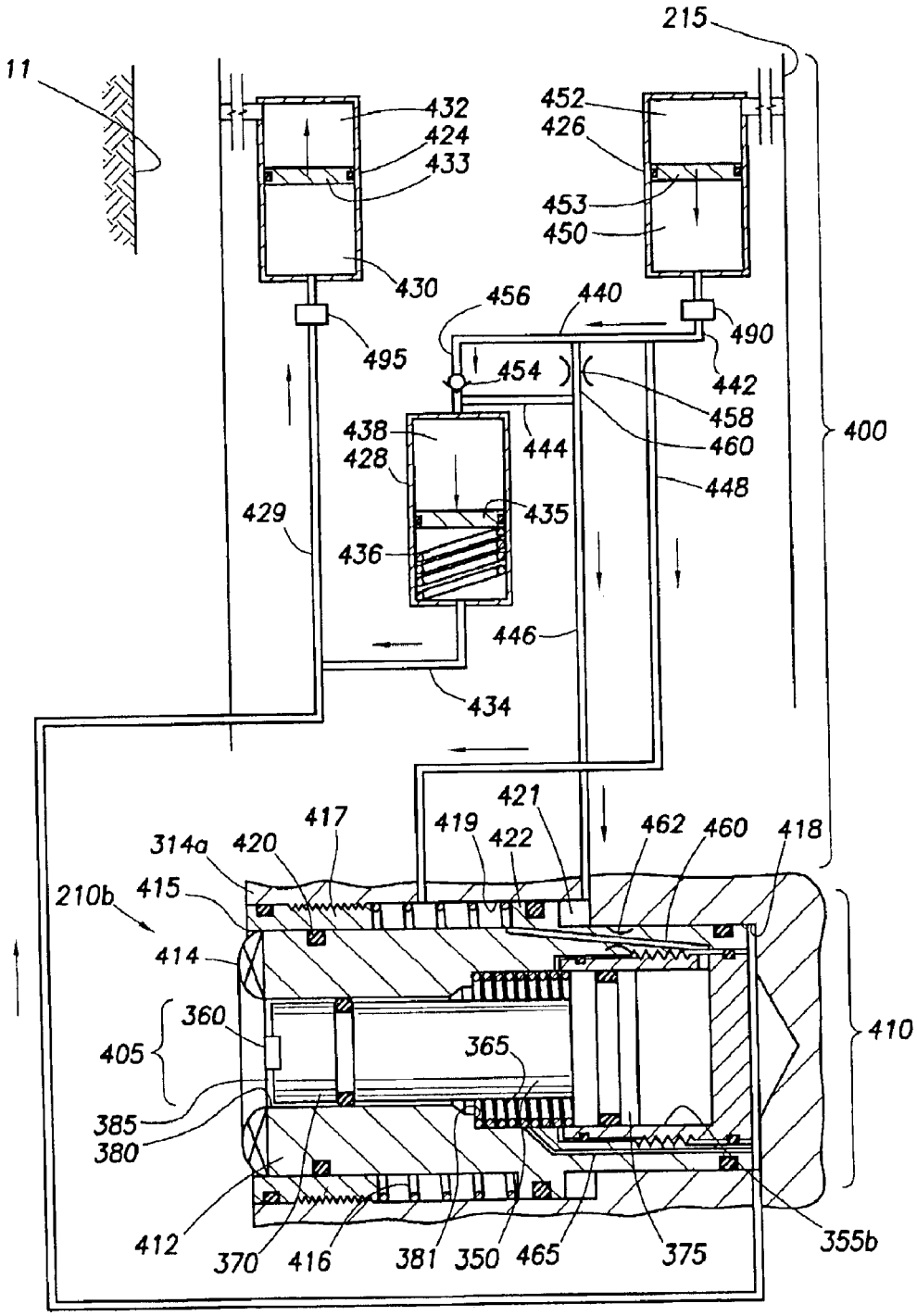
FIG. 4B is a cross-sectional view of another embodiment of a pressure assembly of FIG. 3 in the retracted position, and a corresponding hydraulic control diagram.

FIGS. 4A and 4B depict the pressure assembly 210*b* in greater detail. FIG. 4A depicts the pressure assembly 210*b* in the extended position. FIG. 4B depicts the pressure assembly 210*b* in the retracted position. A corresponding hydraulic control circuit 400 is depicted in schematic for each of these figures to further describe the operation of the pressure assembly in each position.

The pressure assembly 210*b* includes an internal pressure assembly 405 mounted within a probe assembly 410. The probe assembly 410 includes a carriage 412, a packer 414, a spring 416 and a collar 417. The carriage 412 is positioned in a chamber 418 in stabilizer blade 314*a* and is slidably movable therein. Seals 420 may be provided to seal the probe in the chamber and facilitate movement therein. Packer 414, typically of an elastomer or rubber, is provided at an exterior end of the carriage 412 to facilitate sealing engagement with the borehole wall. Collar 417 is preferably threadably mounted within chamber 418 about an opening 415 in the stabilizer blade. The collar 417 encircles the carriage, and the carriage is slidably movable therein. Spring 416 encircles the carriage and is compressed in a pocket 419 between the collar 417 and a shoulder 422 of carriage 412. A pocket 421 is formed between shoulder 422, carriage 412 and the stabilizer blade 314*a*.

The carriage 412 has an internal chamber 355*b* therein. The internal pressure assembly 405 is positioned in the internal chamber 355*b*. Like pressure assembly 210*a* of FIGS. 3A and 3B, the internal pressure assembly 405 includes a piston 350 and a spring 365. The piston has a first portion 375 slidably movable within chamber 355*b*, and a second portion 370 extending therefrom. The second portion 370 extends from the chamber 355*b* into a passage 380 and is slidably movable therein. The piston may be provided with seals to isolate various portions of the chamber from each other and/or from external mud contamination. The piston is preferably provided with a sensor 360 capable of taking downhole measurements. A spring 365 is positioned in chamber 355*b* about the first portion 370. As shown in FIG. 3A, the spring is compressed in a pocket 381 in the chamber 355*b* between the second portion 375 of the piston and the walls of the chamber. Pocket 381 is in fluid communication with chamber 418 via conduit 465. The chamber 355*b* is in fluid communication with oil under pressure from the passage 215 of the downhole too via conduit 460, pocket 419, and conduits 448, 440, and 442.

The hydraulic control circuit 400 used to operate the pressure assembly 210*b* includes a low pressure compensator 424, a high pressure compensator 426, and an accumulator 428. Hydraulic control circuit is preferably provided to allow selective activation or de-activation of the probe and/or pressure sensor assemblies. This additional control may be necessary in drilling, tripping or other situations where activation or de-activation of the pressure control assemblies is desired. The sensor(s) may be used to provide data to determine whether such a situation has occurred.

The compensators are preferably capable of accommodating volume changes caused by the pressure differences, temperature difference and/or movement of the downhole tool. The low pressure compensator 424 is operatively connected to chamber 418 in the stabilizer blade 314*a* via conduit 429. The low pressure compensator has a slidable piston 433 forming a first variable volume chamber 430 and a second variable volume chamber 432. The first chamber 430 is in fluid communication with the conduit 429, and a second chamber 432 in fluid communication with the borehole (and/or the annual pressure $P_A$ therein).

Accumulator 428 is operatively connected to conduit 429 via conduit 434. The accumulator stores oil at high pressure, and may be used to increase pressure in chamber 421. The accumulator has a spring-loaded piston 435 defining a first chamber 436 and a second chamber 438. The first chamber 436 is in fluid communication with conduit 434 and conduit 429. The second chamber 438 of the accumulator is connected via conduits 456, 440 and 442 to the high pressure compensator 426; via conduits 444 and 446 to the chamber 421; and via conduits 444, 460, 440 and 442 to pocket 419.

The high pressure compensator 426 has a slidable piston 453 defining a first variable volume chamber 450 and a second variable volume chamber 452. The first chamber 450 is in fluid communication with chamber 421 via conduits 442, 440 and 446; with the accumulator 428 via conduits 442, 440 and 456; and with pocket 419 via conduits 442, 440, and 448. A check valve 454 is positioned in conduit 456 to prevent fluid from flowing from second chamber 438 of accumulator 428 to conduit 440. The second chamber 452 of high pressure compensator 426 is in fluid communication with passage 215 of stabilizer collar 300*a* (FIG. 2) and the internal pressure $P_I$ therein.

Various devices may be provided in the control circuit to monitor, manipulate and/or control the flow of fluid and/or the operation of the probe and/or pressure assemblies. Internal pressure sensor 490 may be provided to monitor the internal pressure in passage 425. Annular pressure sensor 495 may be provided to monitor the annular pressure of the wellbore. Both pressure may also be monitored simultaneously via a differential pressure sensor (not shown). A choke 458 (or leak orifice, electrical controller or other restrictor) is preferably provided in conduit 460 to slow the flow of fluid through conduit 460 (ie. between the second chamber 438 of accumulator 428 and the high pressure compensator 426). A choke 462 is preferably positioned in conduit 460 to restrict and/or delay the flow of fluid out of chamber 355*b*.

An electrical on-off switch (not shown) may also be provided to activate the hydraulic control circuit 400. Once activated, no further signals are required to activate the system to perform tests. The system is capable of operating without activation. However, it is possible to add electronic controls and/or signals for communication with the system. One way to affect such activation is by incorporating an on/off switch into the hydraulic control system. An electrical on/off switch may be connected to the first chamber 430 of the low pressure compensator and/or the first chamber 450 of the high pressure compensator to send a signal to isolate the high pressure compensator from the system. In this case, the accumulator would not be charged and the differential pressure changes would no longer have an effect on the system.

In the position depicted in FIG. 4A, the pressure assembly 210*b* is in the extended position. Fluid is no longer flowing through the downhole tool to create a differential pressure. The pressure of the fluid in second chamber 452 of high pressure compensator 426 is reduced and piston 453 can travel to reduce the size of chamber 452. Corresponding chamber 450 increases and draws fluid out of pocket 419 and permits the spring 416 to retract thereby shifting carriage 412 out of blade 314*a*. The loss of internal pressure in chamber 452 also causes fluid in accumulator chamber 438 to be expelled into conduit 444. Most of the fluid in conduit 444 flows via conduit 446 into pocket 421 thereby placing force against shoulder 422 to move the carriage outward from the stabilizer blade. Some fluid is permitted to flow through conduit 460 and into conduit 440. However, choke 458 restricts the flow of fluid therethrough and only allows a limited bleed off of this fluid.

As fluid in accumulator chamber 438 is expelled, the piston 435 moves and expands chamber 436. Fluid is drawn from chamber 430 of low pressure compensator 433 into chamber 436 via conduits 434 and 429. Fluid in chamber 430 is also permitted to flow via flowline 429 into chamber 418.

The internal pressure assembly 405 is also movable within the probe assembly 410 between an open, or testing, position as depicted in FIG. 4A, and a closed position as depicted in FIG. 4B. As shown in FIG. 4A, when the tool comes to a rest and fluid stops flowing through the tool, the pressure in chamber 355*b* drops with the reduction in pressure differential between the internal pressure and the borehole pressure. The pressure in chamber 355*b* releases through conduit 460 into pocket 419. As the pressure in chamber 355*b* decreases, the force of the spring 365 pushes the piston into chamber 355*b*. A choke may be provided to restrict the flow through conduit 465 to provide a delay, if desired. The fluid in pocket 381 is in fluid communication with chamber 418 via conduit 465. Flow into pocket 418 is preferably slow and delayed such that the probe assembly is fully extended from blade 314*a* before piston 350 travels.

Retraction of the piston into the collar creates a cavity 395 (typically of about 1 cc to about 3 cc) extending from an opening 385 and into the passage 380. Fluid from the formation is permitted to fill the cavity 395 when a seal is formed between the packer 414 and the formation. Pressure sensor 360 is preferably positioned adjacent the cavity to measure the pressure of the fluid in the cavity as the piston retracts into the tool. A pretest and/or other measurements may then be taken to determine various downhole properties of the surrounding formation.

The movement of the internal pressure assembly 405 and the probe assembly 410 may be manipulated such that movement occurs at the desired time. For example, the choke may be used to delay the flow of fluid and the corresponding retraction of the internal pressure assembly to allow sufficient time for a seal to form between the probe assembly and the borehole wall. Other variations to the circuitry may be envisioned to provide selective flow of fluid through the circuit and manipulate the operation of the pressure assembly.

Once the spring accumulator 428 has fully expanded, oil/pressure from chamber 438 bleeds off through conduits 444, 460, 440, and 442 into chamber 450. The pressure in conduit 446 continues to drop until it reaches the ambient hydrostatic pressure. The spring 416 retracts the probe assembly back into blade 314*a* and completes the cycle. Piston 350 is in its open, or testing position, and the process may be repeated.

FIG. 4B depicts pressure assembly 210*b* during a charge cycle operation of the downhole tool. When fluid is pumped through internal passage 215, it creates a higher internal pressure $P_I$ with respect to the annular pressure thereby creating a differential pressure. This differential pressure forces piston 453 to expand chamber 452 and reduce chamber 450. Fluid is expelled from chamber 450 into chamber 428 via conduits 442, 440 and 456. Fluid is also expelled from chamber 436 and into chamber 430 via conduits 434 and 429. The flow of fluid into chamber 430 causes fluid in chamber 432 to be expelled into the borehole.

Fluid also flows from chamber 450 into chamber 355*b* via conduits 442 and 448, pocket 419, and conduit 460. The flow of fluid into chamber 355*b* overcomes the force of the spring 365 and causes the piston to move toward opening 385. The spring 365 is compressed in pocket 381 between the second portion 375 and the walls of the chamber. Fluid is released from pocket 381 via conduit 465 to chamber 418 and back to chamber 430 via conduit 429. The first portion 375 of the piston is pressed against the spring 365, and the second portion, or rod, 370 fills the passage 380. The internal pressure assembly 405 is now charged to perform the next pressure measurement.

Figure 5B:
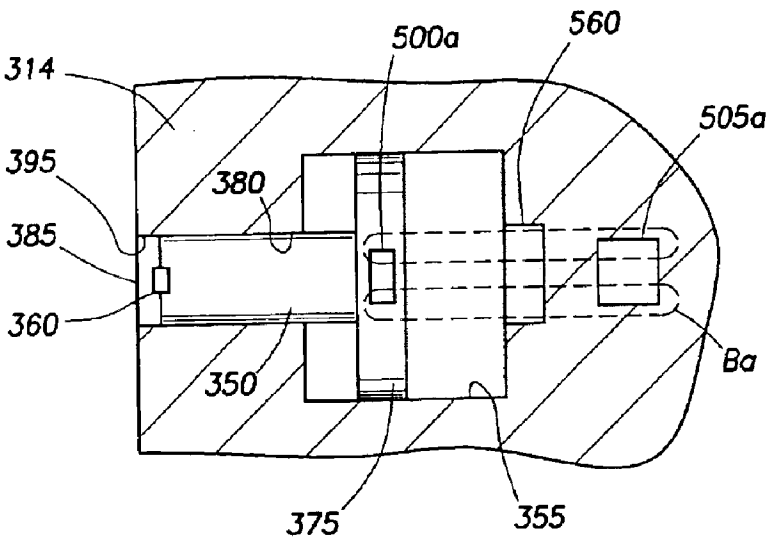
FIG. 5B is a schematic view detailing another embodiment of electronics for the pressure assembly of FIG. 2.
Figure 5A:
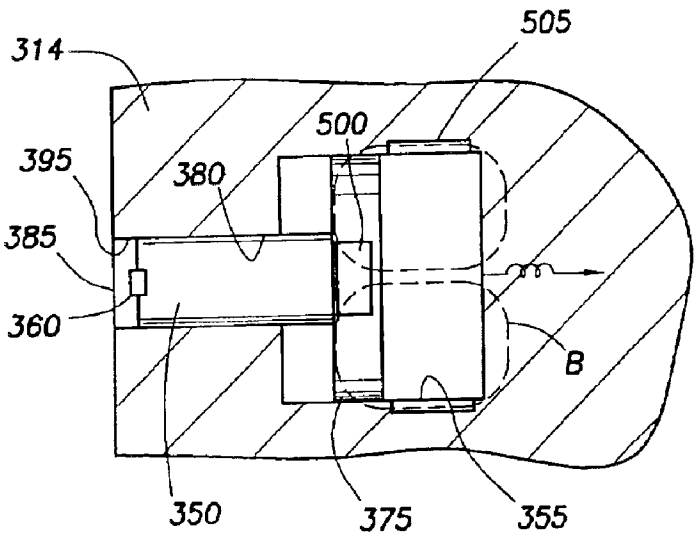
FIG. 5A is a schematic view detailing a first embodiment of electronics for the pressure assembly of FIG. 2.

Referring now to FIGS. 5A and 5B, the electronic details for the pressure assembly is shown in greater detail. FIG. 5A depicts an overlapping communication coil embodiment, and FIG. 5B depicts a back-to-back coil embodiment. The sensor 360 is preferably a small sensor, such as a MEMS sensor, positioned on an outer end of the piston 350 adjacent opening 385 in the passage 380. The sensor is preferably capable of measuring various downhole parameters, such as pressure, temperature, viscosity, permeability chemical composition, H2S, and/or other downhole parameters. Hermetical seals may be provided to seal the sensor in the end of the piston. The seals may be provided to reduce the required test volume in cavity 395 to achieve the desired measurements. Contacts are provided between the sensor and the tool via hermetically sealed feed-through to the tool electronics.

The tool electronics preferably provide power for and/or communication with the sensors. In FIG. 5A, the overlapping communication coil embodiment includes a sensor coil 500 and a transmission coil 505. The sensor coil 500 is preferably positioned in the first portion 375 of piston 350. The transmission coil 505 is preferably positioned in about chamber 355. At least a portion of the sensor and/or transmission coils are preferably made of a non-conductive material, such as a ceramic.

A magnetic field is B created between sensor coil 500 and transmission coil 505. The field enables a wireless coupling between the sensor coil and transmission coil. Power and data transfer is provided to the sensor through the wireless coupling. However, a wired coupling is used to create a link between the pressure assembly electronics and the electronics in the remainder of the tool as depicted by the curled arrow. The transmission coil preferably overlaps with the sensor coil, but is independent of the sensor position within chamber 355.

The back-to-back coil embodiment of FIG. 5B includes a sensor coil 550*a*, a transmission coil 555*a* and a ceramic window 560. The sensor coil 500*a* is preferably positioned in the first portion 375 of piston 350. The ceramic window 560 is preferably positioned on an internal wall of chamber 355. The transmission coil 505*a* is preferably positioned in the drill collar adjacent the ceramic window.

A magnetic field Ba is created between sensor coil 500*a* and transmission coil 505*a* through ceramic window 560. A field provides a wireless connection between the sensor coil and transmission coil. Power and data transfer is provided to the sensor through the wireless coupling. In this embodiment, a wireless coupling may also be used to create a link between the pressure assembly electronics and the electronics in the remainder of the tool.

This embodiment eliminates the need for wires for the sensor and the surrounding threaded cup. One or more non-metallic ceramic windows may be positioned between the sensor coil and the transmission coil to allow coupling therethrough. The mechanical assembly eliminates the need for feed-throughs for the coil wire. Instead the-metallic window(s) between the sensor and the host transmission coil are provided. The windows allow coupling between the two coils. While the depicted embodiments eliminate wired connections and/or feed-throughs, some embodiments may incorporate such items.

Figure 6:
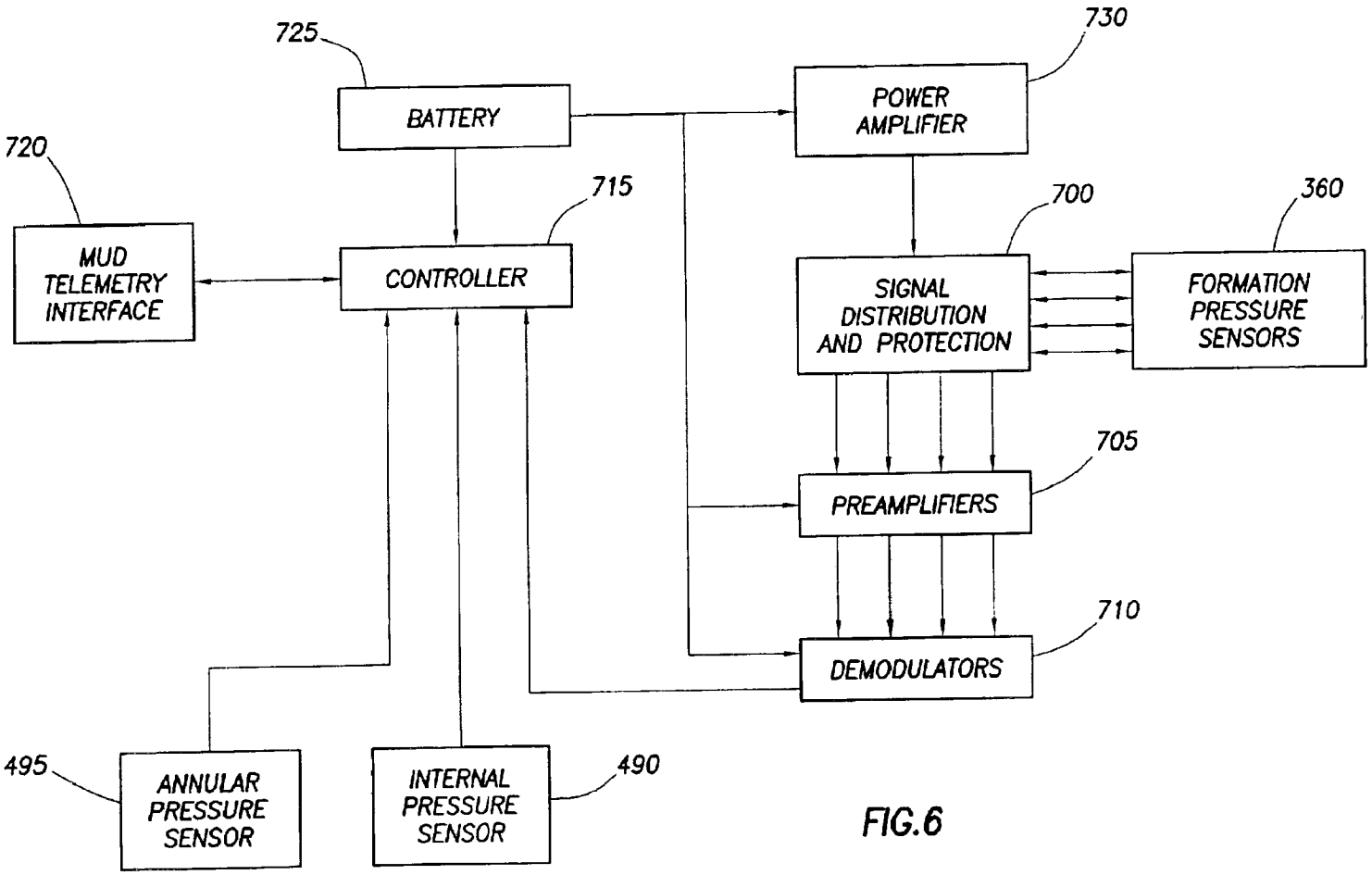
FIG. 6 is a block diagram depicting the electronics of the pressure assemblies of FIG. 2.

FIG. 6 depicts an electronic block diagram for operation of the pressure assemblies. One or more pressure assemblies having pressure sensors 360 therein are used to collect downhole data. The sensors are linked to the downhole electronics either through a wireless link as depicted in FIG. 5A, or wirelessly as depicted in FIG. 5B. Power and/or communication signals are distributed and protected using distribution device 700. The signals pass through preamplifiers 705 and demodulators 710 and are sent to a controller 715 for processing. Signals may also be collected from one or more sensors, such as internal pressure sensor 490 and/or an annular pressure sensor 495, and processed in the controller. The controller may be used to analyze, collect, sort, manipulate and/or otherwise process the data. The data may be sent to the surface via a mud telemetry interface 720. Signals may also be sent downhole via the mud telemetry interface to the controller.

A battery 725 may be included to provide power to the controller and/or to the sensors. The battery delivers power to a power amplifier 730. The power signal is passed through the signal distribution and protection device to the pressure sensor(s) 360. The power signal can be used to provide power to the sensor(s).

While the invention has been described with respect to a limited number of embodiments, those skilled in the art, having benefit of this disclosure, will appreciate that other embodiments can be devised which do not depart from the scope of the invention as disclosed herein. For example, embodiments of the invention may be easily adapted and used to perform specific formation sampling or testing operations without departing from the spirit of the invention. Accordingly, the scope of the invention should be limited only by the attached claims.

What is claimed is:

1. An apparatus for collecting downhole data during a drilling operation via a downhole drilling tool positioned in a wellbore, the wellbore having an annular pressure therein, the wellbore penetrating a subterranean formation having a pore pressure therein, the downhole tool adapted to pass a drilling mud flowing therethrough such that an internal pressure is created therein, the internal pressure and annular pressure generating a differential pressure therebetween, the apparatus comprising:

a drill collar operatively connectable to a drill string of the drilling tool, the drill collar having a passage therein for passing the drilling mud therethrough, the drill collar having a collar opening therein extending into a pressure chamber, the pressure chamber in fluid communication with one of the passage, the wellbore and combinations thereof;

a piston slidably positioned in the pressure chamber and having a rod extending therefrom into the collar opening, the piston movable to a closed position in response to an increase in differential pressure and to an open position in response to a decrease in differential pressure such that in the closed position the rod fills the opening and in the open position at least a portion of the rod is drawn into the chamber such that a cavity is formed in the opening for receiving downhole fluid; and a sensor positioned in the rod for collecting data from the downhole fluid in the cavity.

2. The apparatus of claim 1 further comprising a spring operatively connected to the piston, the spring capable of applying a force to the piston so that the piston is urged to the open position.

3. The apparatus of claim 2 wherein when drilling mud flows through the passage, the differential pressure applies a force sufficient to overcome the force of the spring.

4. The apparatus of claim 2 wherein when the drilling mud is not flowing through the passage, the differential pressure applies a force insufficient to overcome the force of the spring.

5. The apparatus of claim 1 further comprising an electronic coupling between the sensor and electronic circuitry in the downhole tool.

6. The apparatus of claim 5 wherein the electronic coupling comprises a sensor coil wirelessly coupled to a transmission coil.

7. The apparatus of claim 6 wherein the sensor coil is positioned in the piston and the transmission coil is positioned about the pressure chamber.

8. The apparatus of claim 5 wherein the electronic coupling is coupled via a wire link to the electronic circuitry in the downhole tool.

9. The apparatus of claim 4 wherein the electronic coupling comprises a sensor coil, a transmission coil and a ceramic window therebetween, the sensor coil wirelessly coupled to the transmission coil through the ceramic window.

10. The apparatus of claim 9 wherein the electronic coupling is coupled via a wireless link to the electronic circuitry in the downhole tool.

11. The apparatus of claim 4 further comprising a controller operatively coupled to the pressure sensors, the controller adapted to process signals from the pressure sensor for uphole use.

12. The apparatus of claim 11 further comprising a signal processor, preamplifier and demodulator for processing the sensor signals.

13. The apparatus of claim 11 further comprising an internal pressure sensor, the internal pressure sensor capable of detecting internal pressure in the passage.

14. The apparatus of claim 13 further comprising an annular pressure sensor, the annular pressure sensor capable of detecting annular pressure in the wellbore.

15. The apparatus of claim 11 further comprising a differential pressure sensor.

16. The apparatus of claim 1 further comprising a probe positioned in the pressure chamber and movable therein between a retracted position within the drill collar and an extended position extending therefrom, the probe having a probe opening therein extending into a probe chamber, the piston positioned in the probe chamber such that in the closed position the rod fills the probe opening and in the open position at least a portion of the rod is drawn into the probe chamber such that a cavity is formed in the probe opening for receiving downhole fluid.

17. The apparatus of claim 16 further comprising a packer at an end thereof for sealingly engaging a wall of the wellbore.

18. The apparatus of claim 16 further comprising a spring operatively connected to the probe, the spring capable of applying a force to the probe so that the probe is urged to the extended position.

19. The apparatus of claim 18 wherein when the drilling mud is flowing through the passage, the differential pressure applies a force sufficient to overcome the force of the spring.

20. The apparatus of claim 18 wherein when the drilling mud is not flowing through the passage, the differential pressure applies a force insufficient to overcome the force of the spring.

21. The apparatus of claim 16 further comprising an annular pressure cylinder, an internal pressure cylinder and an accumulator, the annular pressure cylinder in fluid communication with the wellbore and the pressure chamber, the annular pressure cylinder in fluid communication with the passage and one of the a first pocket in the chamber between the probe and the drill collar, a second pocket in the chamber between the probe and the drill collar and combinations thereof, the accumulator in fluid communication with the annular and internal pressure chambers.

22. The apparatus of claim 21 wherein the accumulator in selective fluid communication with the internal pressure chamber.

23. The apparatus of claim 22 further comprising a check valve capable of allowing fluid to exit the accumulator and flow into the internal pressure chamber.

24. The apparatus of claim 23 further comprising a choke capable of releasing pressure in a flow line between the internal pressure chamber and one of the accumulator, the second pocket and combinations thereof.

25. The apparatus of claim 23 further comprising a switch for selectively activating the pressure cylinders.

26. An apparatus for collecting downhole data during a drilling operation via a downhole drilling tool positioned in a wellbore, the wellbore having an annular pressure therein, the wellbore penetrating a subterranean formation having a pore pressure therein, the downhole tool adapted to pass a drilling mud flowing therethrough such that an internal pressure is created therein, the internal pressure and annular pressure generating a differential pressure therebetween, the apparatus comprising:

a drill collar operatively connectable to a drill string of the drilling tool, the drill collar having a passage therein for passing the drilling mud therethrough, the drill collar having a collar opening therein extending into a pressure chamber, the pressure chamber in fluid communication with one of the passage, the wellbore and combinations thereof;

a probe slidably positioned in the pressure chamber, the probe movable between a retracted position in the pressure chamber and an extended position extending from the drill collar through the collar opening, the probe positionable adjacent the sidewall of the wellbore for sealing engagement therewith, the probe having a probe opening therethrough extending into a probe chamber therein;

a piston slidably positioned in the probe chamber and having a rod extending therefrom into the probe opening, the piston movable to a closed position in response to an increase in differential pressure and to an open position in response to a decrease in differential pressure such that in the closed position the rod fills the opening and in the open position at least a portion of the rod is drawn into the chamber such that a cavity is formed in the probe opening for receiving downhole fluid; and a sensor positioned in the rod for collecting data from the downhole fluid in the cavity.

27. The apparatus of claim 26 further comprising a spring operatively connected to the piston, the spring capable of applying a force to the piston so that the piston is urged to the open position.

28. The apparatus of claim 27 wherein when the drilling mud is flowing through the passage, the differential pressure applies a force sufficient to overcome the force of the spring.

29. The apparatus of claim 28 wherein when the drilling mud is not flowing through the passage, the differential pressure applies a force insufficient to overcome the force of the spring.

30. The apparatus of claim 26 further comprising an electronic coupling between the sensor and electronic circuitry in the downhole tool.

31. The apparatus of claim 30 wherein the electronic coupling comprises a sensor coil wirelessly coupled to a transmission coil.

32. The apparatus of claim 31 wherein the sensor coil is positioned in the piston and the transmission coil is positioned about the pressure chamber.

33. The apparatus of claim 30 wherein the electronic coupling is coupled via a wire link to the electronic circuitry in the downhole tool.

34. The apparatus of claim 33 wherein the electronic coupling comprises a sensor coil, a transmission coil and a ceramic window therebetween, the sensor coil wirelessly coupled to the transmission coil through the ceramic window.

35. The apparatus of claim 34 wherein the electronic coupling is coupled via a wireless link to the electronic circuitry in the downhole tool.

36. The apparatus of claim 30 further comprising a controller operatively coupled to the pressure sensors, the controller adapted to process signals from the pressure sensor for uphole use.

37. The apparatus of claim 36 further comprising a signal processor, preamplifier and demodulator for processing the sensor signals.

38. The apparatus of claim 36 further comprising an internal pressure sensor, the internal pressure sensor capable of detecting internal pressure in the passage.

39. The apparatus of claim 38 further comprising an annular pressure sensor, the annular pressure sensor capable of detecting annular pressure in the wellbore.

40. The apparatus of claim 39 further comprising a packer at an end thereof for sealingly engaging a wall of the wellbore.

41. The apparatus of claim 26 further comprising a spring operatively connected to the probe, the spring capable of applying a force to the probe so that the probe is urged to the extended position.

42. The apparatus of claim 41 wherein when the drilling mud is flowing through the passage, the differential pressure applies a force sufficient to overcome the force of the spring.

43. The apparatus of claim 41 wherein when the drilling mud is not flowing through the passage, the differential pressure applies a force insufficient to overcome the force of the spring.

44. The apparatus of claim 40 further comprising an annular pressure cylinder, an internal pressure cylinder and an accumulator, the annular pressure cylinder in fluid communication with the wellbore and the pressure chamber, the annular pressure cylinder in fluid communication with the passage and one of the a first pocket in the chamber between the probe and the drill collar, a second pocket in the chamber between the probe and the drill collar and combinations thereof, the accumulator in fluid communication with the annular and internal pressure chambers.

45. The apparatus of claim 44 wherein the accumulator in selective fluid communication with the internal pressure chamber.

46. The apparatus of claim 44 further comprising a check valve capable of allowing fluid to exit the accumulator and flow into the internal pressure chamber.

47. The apparatus of claim 44 further comprising a choke capable of releasing pressure in a flow line between the internal pressure chamber and one of the accumulator, the second pocket and combinations thereof.

48. The apparatus of claim 44 further comprising a switch for selectively activating the pressure cylinders.

49. A method of collecting downhole data during a drilling operation via a downhole drilling tool positioned in a wellbore, the wellbore having an annular pressure therein, the wellbore penetrating a subterranean formation having a pore pressure therein, a differential pressure being generated between the internal pressure and the annular pressure, the method comprising:

providing a downhole drilling tool with a drill collar having a passage therethrough, the drill collar having an opening therein extending into a chamber and a piston slidably positioned in the chamber and having a rod extending therefrom into the opening, the piston movable between a closed and an open position;

positioning the downhole drilling tool into a wellbore;

selectively changing the differential pressure such that the piston is moved between the open and closed position;

sensing data from the downhole fluid in the cavity.

50. The method of claim 49 wherein the change in differential pressure occurs automatically as a result in changes in one of the annular pressure, the internal pressure and combinations thereof.

51. The method of claim 49 wherein the step of selectively changing occurs by selectively passing drilling fluid through the downhole tool.

52. The method of claim 49 wherein in the open position, a small volume is created in the opening to receive downhole fluids.

53. The method of claim 49 wherein the step of sensing comprises sensing comprises sensing downhole data from an exterior position on the probe.

54. The method of claim 49 further comprising providing power to the piston.

55. The method of claim 54 wherein the power is provided by a remote power source.

56. The method of claim 54 wherein the power is provided by changes in differential pressure.

57. The method of claim 49 further comprising sensing data from one of an internal pressure sensor in the downhole tool, an annual pressure sensor in the downhole tool and combinations thereof.

58. The method of claim 49 further comprising processing the data for uphole use.

* * * * *